US007628012B2

(12) United States Patent
Eifert et al.

(10) Patent No.: US 7,628,012 B2
(45) Date of Patent: Dec. 8, 2009

(54) EXHAUST TEMPERATURE REDUCTION DEVICE FOR AFTERTREATMENT DEVICES

(75) Inventors: Michael J. Eifert, Fort Wayne, IN (US); Andrea Brown, Naperville, IL (US); Mark A. Schmale, Fort Wayne, IN (US); Jeffrey R. Kelso, Fort Wayne, IN (US); Timothy Juan, Fort Wayne, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 11/974,083

(22) Filed: Oct. 12, 2007

(65) Prior Publication Data

US 2009/0095556 A1 Apr. 16, 2009

(51) Int. Cl.
*F01N 5/04* (2006.01)

(52) U.S. Cl. ..... 60/319

(58) Field of Classification Search ..... 60/298, 60/319, 320, 321, 324, 317, 289, 282, 308; 181/259, 262, 226, 220, 224
See application file for complete search history.

(56) References Cited

U.S. PATENT DOCUMENTS

| | | | | | |
|---|---|---|---|---|---|
| 1,762,465 | A | * | 6/1930 | Bovey | 165/41 |
| 1,783,674 | A | | 12/1930 | Rehwold et al. | |
| 2,211,795 | A | | 8/1940 | Sauer | |
| 2,293,632 | A | | 8/1942 | Sauer | |
| 2,297,425 | A | * | 9/1942 | Meissner | 60/225 |
| 2,396,942 | A | | 3/1946 | Couch | |
| 2,737,164 | A | * | 3/1956 | Thorp et al. | 123/41.64 |
| 3,186,511 | A | | 6/1965 | Kilewer, Sr. | |
| 3,241,316 | A | * | 3/1966 | Endres | 60/39.5 |
| 3,605,389 | A | * | 9/1971 | Butler | 55/482.1 |
| 3,967,445 | A | * | 7/1976 | Manfredi | 60/279 |
| 4,265,332 | A | | 5/1981 | Presnall et al. | |
| 4,331,213 | A | * | 5/1982 | Taniguchi | 181/263 |
| 4,339,918 | A | * | 7/1982 | Michikawa | 60/316 |
| 4,905,633 | A | * | 3/1990 | Kakuta | 123/41.64 |
| 5,165,231 | A | * | 11/1992 | Rich | 60/316 |
| 5,282,361 | A | * | 2/1994 | Sung | 60/315 |
| 5,454,139 | A | | 10/1995 | Beck | |
| 5,979,159 | A | * | 11/1999 | Adamczyk et al. | 60/274 |
| 5,987,885 | A | * | 11/1999 | Kizer et al. | 60/298 |
| 6,571,551 | B2 | * | 6/2003 | Lundgren et al. | 60/298 |
| 6,748,736 | B1 | * | 6/2004 | Claverie et al. | 60/298 |
| 6,832,665 | B2 | | 12/2004 | Crombeen | |
| 6,854,267 | B2 | * | 2/2005 | Zillmer et al. | 60/298 |
| 6,871,489 | B2 | * | 3/2005 | Tumati et al. | 60/285 |

(Continued)

FOREIGN PATENT DOCUMENTS

WO WO2007114646 A1 * 10/2007

*Primary Examiner*—Thomas E Denion
*Assistant Examiner*—Jonathan Matthias
(74) *Attorney, Agent, or Firm*—Jeffrey P. Calfa; Mark C. Bach; Gerald W. Askew

(57) ABSTRACT

An Exhaust Temperature Reduction Device for Aftertreatment Device is provided useful for lowering the temperature of exhaust gasses exiting the tailpipe of a vehicle having an aftertreatment device. The Exhaust Temperature Reduction Device for Aftertreatment Device may be manufactured from a single piece of formed sheet metal, two pieces of formed sheet metal that have been joined, or a net formed process such as investment cast stainless steel.

16 Claims, 11 Drawing Sheets

MIXING DEVICE WITH EXHAUST FLOW

U.S. PATENT DOCUMENTS

| | | | | |
|---|---|---|---|---|
| 6,926,074 | B2 * | 8/2005 | Worner | 165/159 |
| 6,973,959 | B1 * | 12/2005 | Claverie et al. | 165/51 |
| 2005/0205355 | A1 * | 9/2005 | Lin | 181/279 |
| 2007/0119985 | A1 * | 5/2007 | Ranganathan et al. | 239/398 |
| 2007/0137190 | A1 * | 6/2007 | Leseman et al. | 60/316 |
| 2007/0245725 | A1 * | 10/2007 | Brown et al. | 60/317 |
| 2008/0072582 | A1 * | 3/2008 | McNally et al. | 60/320 |
| 2008/0087006 | A1 * | 4/2008 | Wu et al. | 60/280 |
| 2008/0092533 | A1 * | 4/2008 | Tennison | 60/317 |

* cited by examiner

MIXING DEVICE WITH EXHAUST FLOW

MIXING DEVICE WITH AMBIENT AIR FLOW

MIXING DEVICE INSERTED BETWEEN TAILPIPE SEGMENTS

MIXING DEVICE

MIXING DEVICE

MIXING DEVICE WITH
OUTER PORTION REMOVED

MIXING DEVICE WITH
OUTER PORTION REMOVED

MIXING DEVICE WITH OUTER PORTION REMOVED, SHOWING PROPORTIONATE VELOCITY VECTORS OF AMBIENT AIR FLOW

MIXING DEVICE WITH OUTER PORTION REMOVED. SHOWING PROPORTIONATE TEMPERATURE DISTRIBUTION ALONG THE LENGTH OF THE SECOND TAILPIPE SEGMENT.

MIXING DEVICE WITH OUTER PORTION REMOVED. SHOWING PROPORTIONATE TEMPERATURE DISTRIBUTION ALONG THE LENGTH OF THE SECOND TAILPIPE SEGMENT.

MIXING DEVICE WITH
AMBIENT PASSAGE PLUG

EXHAUST TEMPERATURE REDUCTION DEVICE FOR AFTERTREATMENT DEVICES

FIELD OF THE INVENTION

This invention relates to internal combustion engines, including but not limited to exhaust passages containing after-treatment devices for the internal combustion engine.

BACKGROUND

Internal combustion engines generate exhaust gas during operation that contains various chemical compounds. Many modern engines include after-treatment devices associated therewith for treating some of these chemical compounds in the exhaust gas. Typical after-treatment components may include Oxidation Catalysts (OC) and Particulate Filters (PF). Compression ignition engines in particular, may use such devices for treating their exhaust gas.

Treatment, or after-treatment as it is commonly known, is a process of treating exhaust gas that is generated during the operation of an engine and before it is released to the environment. In a typical vehicle, for example, an engine might be connected to an exhaust pipe, or tail pipe, that may carry exhaust gases away from the engine. The vehicle tail pipe may include various after-treatment components, along with other components, for example, mufflers, valves, and so forth.

During operation of an engine, the temperature of the exhaust gases that are generated depends on various factors. During normal engine operation, the temperature of exhaust gas may depend primarily on the speed and load of the engine, and also on other factors, such as barometric pressure, ambient temperature, and so forth. During an idle condition, the temperature of exhaust gas in the tail pipe is expected to be relatively low, for example on some engines about 400 deg. F. (200 deg. C.). During conditions of high loading, for example when the vehicle is traveling at a higher rate of speed under a high load, the temperature of exhaust gas might reach temperatures of 1,500 deg. F. (815 deg. C.).

PF regeneration, as is known, is a periodic process by which trapped matter in the PF burns off to clean the PF. The addition of after-treatment devices, such as a PF, might increase the temperature of exhaust gas at times when such temperature would otherwise be low. This increase in temperature may be due to a regeneration event of the PF that might be taking place, for example, while the engine is idling.

Accordingly, there is a need for avoiding exhaust temperature increases in vehicle tailpipes during times when such temperatures are expected to be low.

SUMMARY OF THE INVENTION

Exhaust temperature increases in vehicle tailpipes during times when such temperatures are expected to be low may advantageously be avoided by use of a mixing device as described herein. An engine system includes an internal combustion engine connected to an exhaust system. A portion of the exhaust system is connected to the internal combustion engine, and an additional portion of the exhaust system is connected to the vehicle and includes a tailpipe which opens to the atmosphere. An after-treatment system is connected to the exhaust system located between the internal combustion engine and the tailpipe. The mixing device is located between a first segment of the tailpipe and a second segment of the tailpipe. The mixing device is arranged to mix a flow of exhaust gas from the first segment of the tailpipe with a flow of ambient air to yield a mixture having lowered temperature as compared to the flow of exhaust gas, and to route the mixture into the second segment of the tailpipe. It operates passively, without the need for moving or powered parts.

The mixing device has several passages through which exhaust gas is directed. Ambient air passages are nested in between the exhaust gas passages. The mixing device is designed so that it may be readily inserted into the first and second segments of the tailpipe, where it may be welded or mechanically fixed in place. It is designed to be manufactured in a net formed process, rather than being constrained to a sheet metal fabrication, though it may be manufactured using sheet metal fabrication if so desired. Preferably, the mixing device may be manufactured of investment cast stainless steel. This provides the shapes and sections required while keeping cost and weight to an acceptable level.

In the embodiment shown, the hot exhaust stream is divided into five separate passages. Each passage is completely surrounded by the ambient air stream in such a way to maximize contact between the hot exhaust stream and the ambient air stream. This maximizes mixing while minimizing backpressure to the exhaust stream.

The mixing device may be tuned in order to control the amount of backpressure experienced by the exhaust stream and to control the maximum temperature at the exhaust outlet of the second segment of the tailpipe. This may be done by use of a restriction or plug located in the ambient air passage of the mixing device, where it may be welded or mechanically fixed in place. It may also be done by varying the length of the second segment of the tailpipe.

As described above, the Exhaust Temperature Reduction Device for Aftertreatment Device and a vehicle made with this device provide a number of advantages, some of which have been described above and others of which are inherent in the invention. Also, modifications may be proposed to the Exhaust Temperature Reduction Device for Aftertreatment Device or a vehicle made with this device without departing from the teachings herein.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE INVENTION

Figure 1:
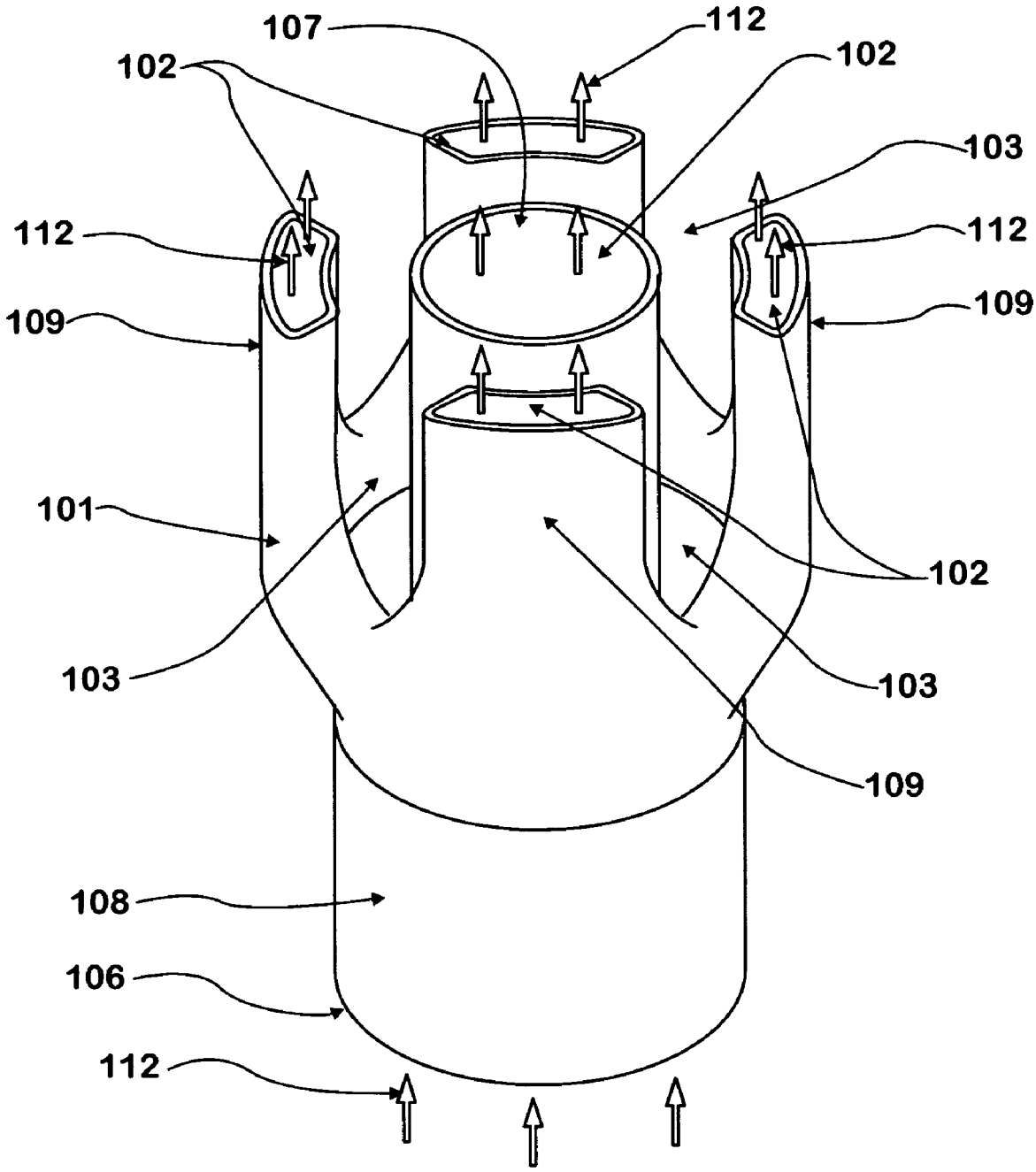
FIG. 1—A first embodiment of the invention.

FIG. 1 shows a mixing device 101 for use in an exhaust system of a vehicle having an internal combustion engine, particularly for an exhaust system having an aftertreatment system, which aftertreatment system results in the generation of very high temperature exhaust gasses. The mixing device 101 in the embodiment shown in FIG. 1 is provided with five exhaust passages 102 spaced regularly between four ambient air passages 103. High temperature exhaust gasses 112 enter the mixing device 101 at the inlet end 106, and are channeled through the five exhaust passages 102 at the outlet end 107. The inlet end 106 is sized such that the engine side exhaust pipe mating surface 108 will slide into and be clamped upon, welded to, or mechanically attached to the engine side exhaust pipe (not shown). The outer exhaust passages 102 of the outlet end 107 are shaped such that the outer surfaces thereof are partially concentrically cylindrical, forming a tailpipe side exhaust pipe mating surface 109.

Figure 2:
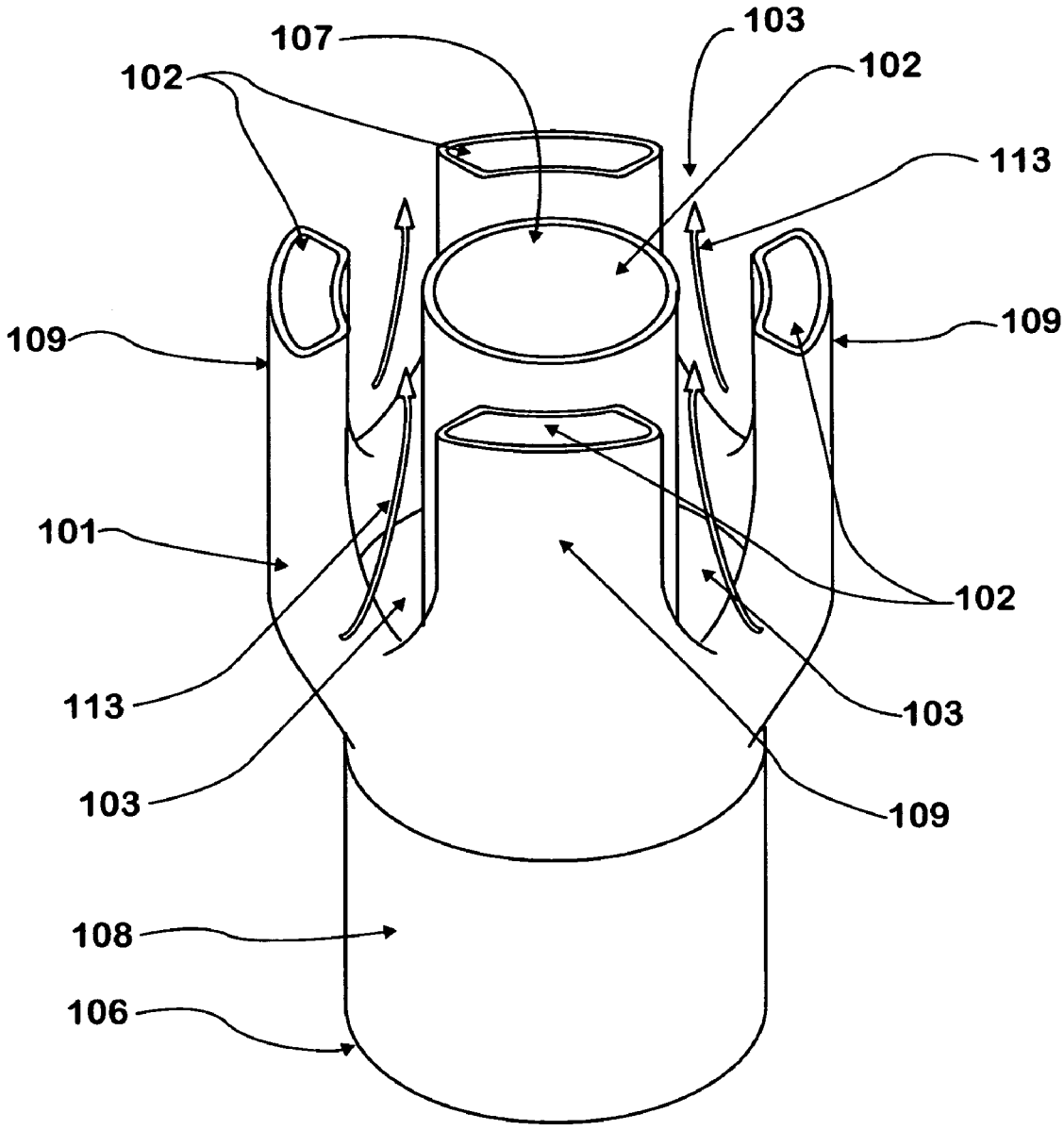
FIG. 2—A second embodiment of the invention.

FIG. 2 shows a mixing device 101 for use in an exhaust system of a vehicle having an internal combustion engine, similar to the mixing device 101 shown in FIG. 1. The mixing device 101 in the embodiment shown in FIG. 2 is again provided with five exhaust passages 102, four ambient air passages 103, an inlet end 106, and an outlet end 107. Ambient air 113 enters the mixing device 101 through the four ambient air passages 103, drawn by a venturi effect created by the high temperature exhaust gasses 112 (not shown) exiting the five exhaust passages 102. The inlet end 106 is again sized such that the engine side exhaust pipe mating surface 108 will slide into and be clamped upon, welded to, or mechanically attached to the engine side exhaust pipe (not shown). The outer exhaust passages 102 of the outlet end 107 are again shaped such that the outer surfaces thereof are partially concentrically cylindrical, forming a tailpipe side exhaust pipe mating surface 109. In this way, a tailpipe (not shown) that is slid over and clamped upon, welded to, or mechanically attached to the outlet end 107 of the mixing device 101 forms the outer wall of the four ambient air passages 103. Ambient air 113 is thereby drawn into and mixed with the high temperature exhaust gasses 112 (not shown) as they enter the tailpipe (not shown).

Figure 3:
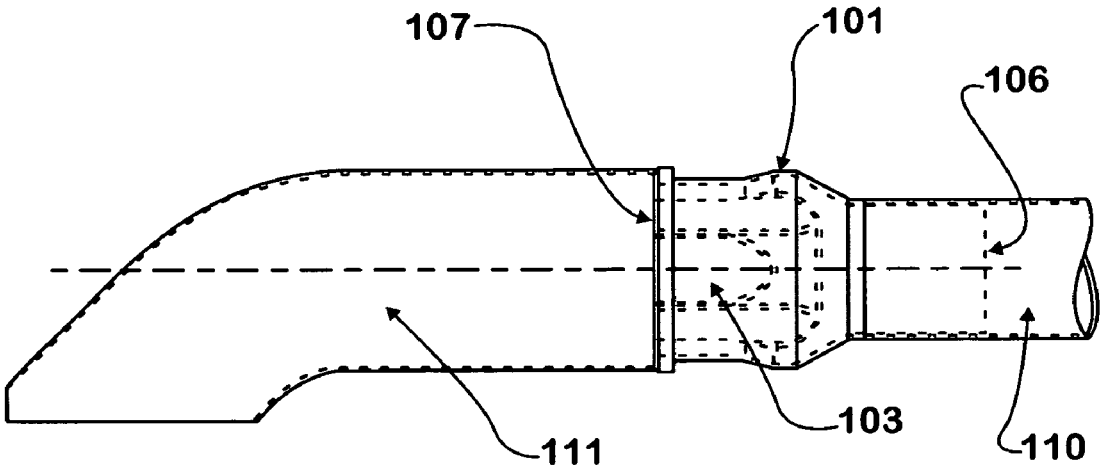
FIG. 3—A third embodiment of the invention.

FIG. 3 shows a mixing device 101 installed, such that the inlet end 106 is inserted into the engine side exhaust pipe 110, and the outlet end 107 is inserted into a tailpipe 111. The ambient air passages 103 remain exposed, such that ambient air is drawn into the tailpipe 111 by the venturi effect of the exhaust gasses exiting the exhaust passages 102 (not visible).

Figure 4:
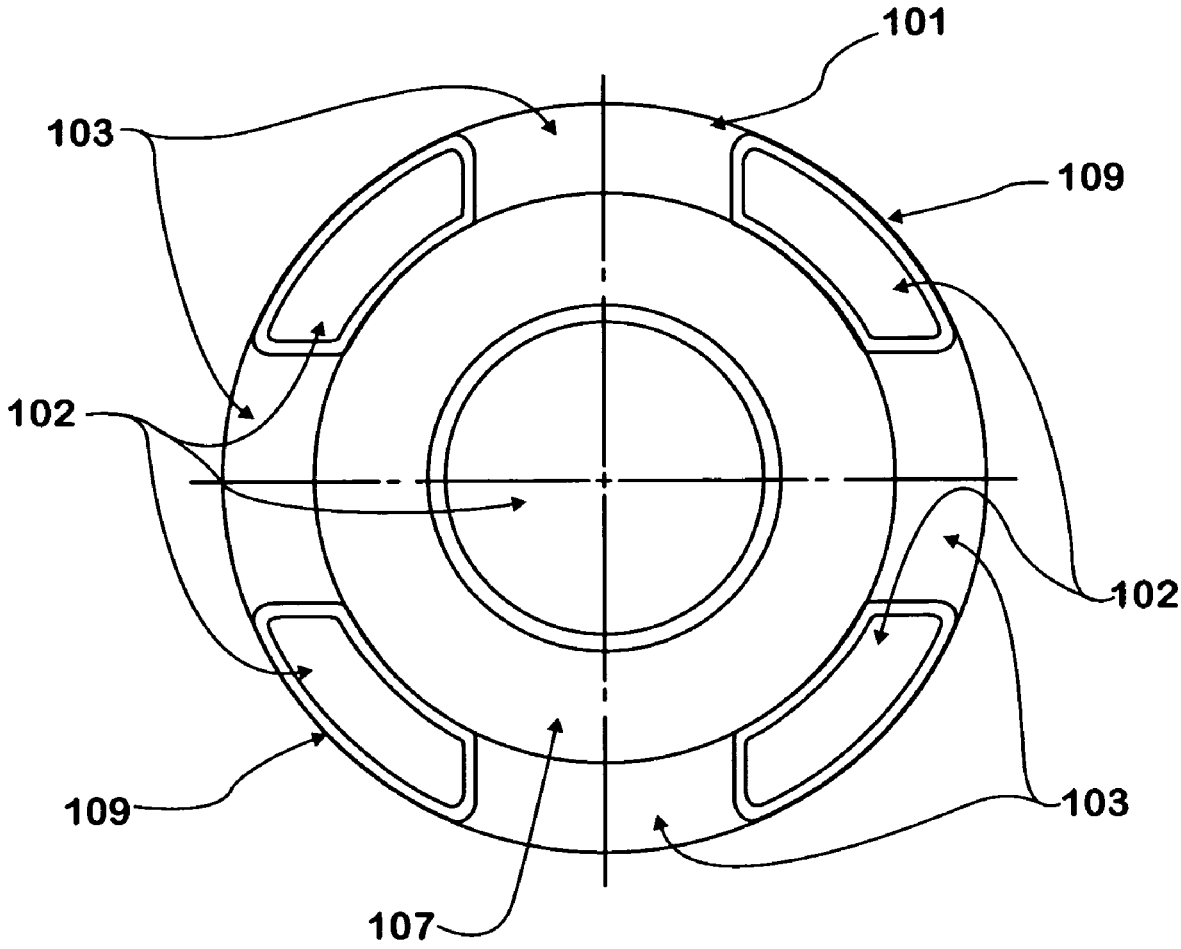
FIG. 4—A fourth embodiment of the invention.

FIG. 4 shows an end view of the outlet end 107 of a mixing device 101, similar to the mixing device 101 shown in FIG. 1. The mixing device 101 shown in FIG. 4 is again provided with five exhaust passages 102 and four ambient air passages 103. Four of the five exhaust passages 102 are so shaped that they form segments of a tailpipe side exhaust pipe mating surface 109.

Figure 5:
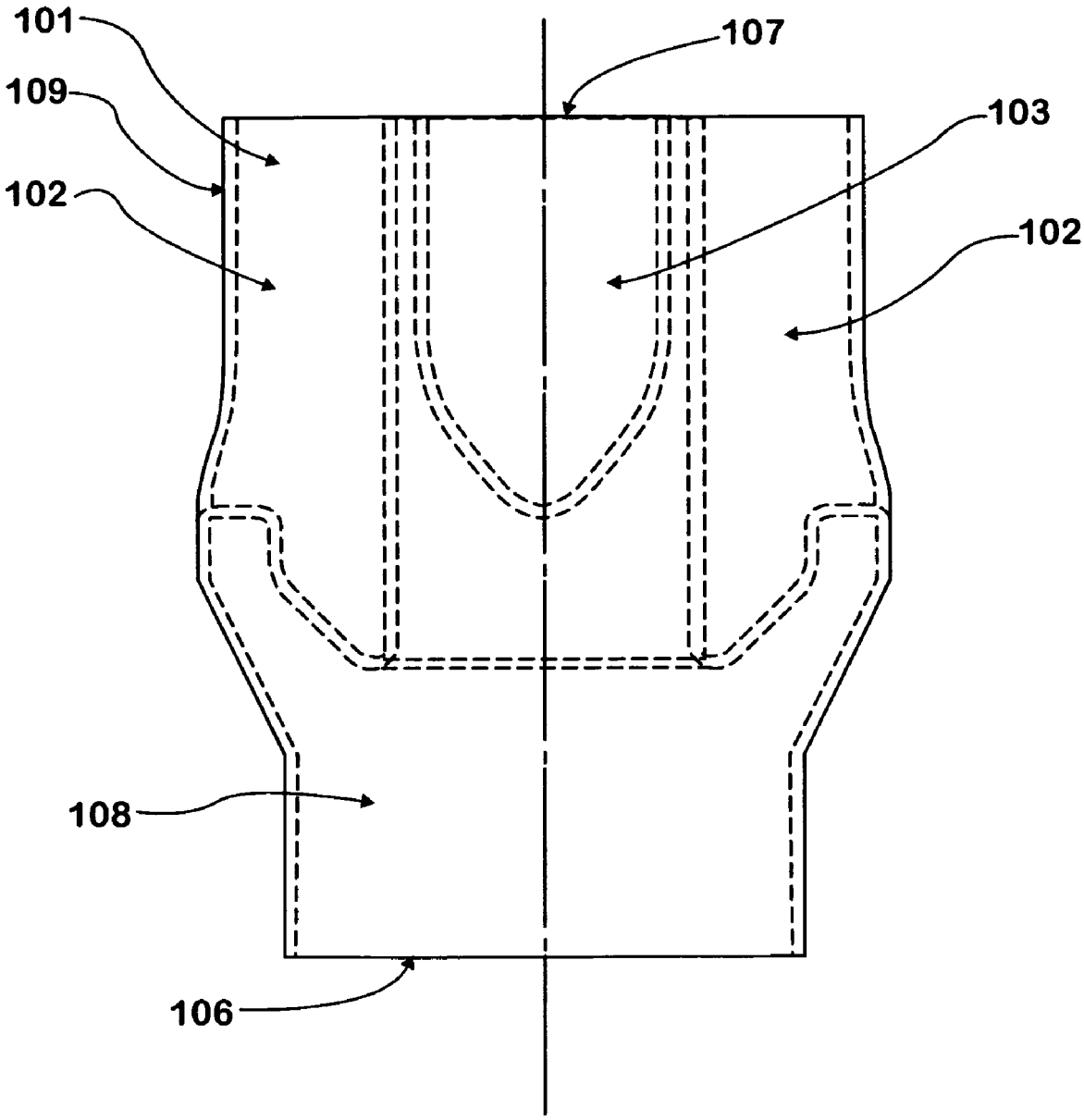
FIG. 5—A fifth embodiment of the invention.

FIG. 5 shows a side view of a mixing device 101, similar to the mixing device 101 shown in FIG. 1. The mixing device 101 shown in FIG. 5 is again provided with exhaust passages 102, ambient air passages 103, an inlet end 106, and an outlet end 107. The inlet end 106 is again provided with an engine side exhaust pipe mating surface 108. The outlet end 107 is again provided with a tailpipe side exhaust pipe mating surface 109.

Figure 6:
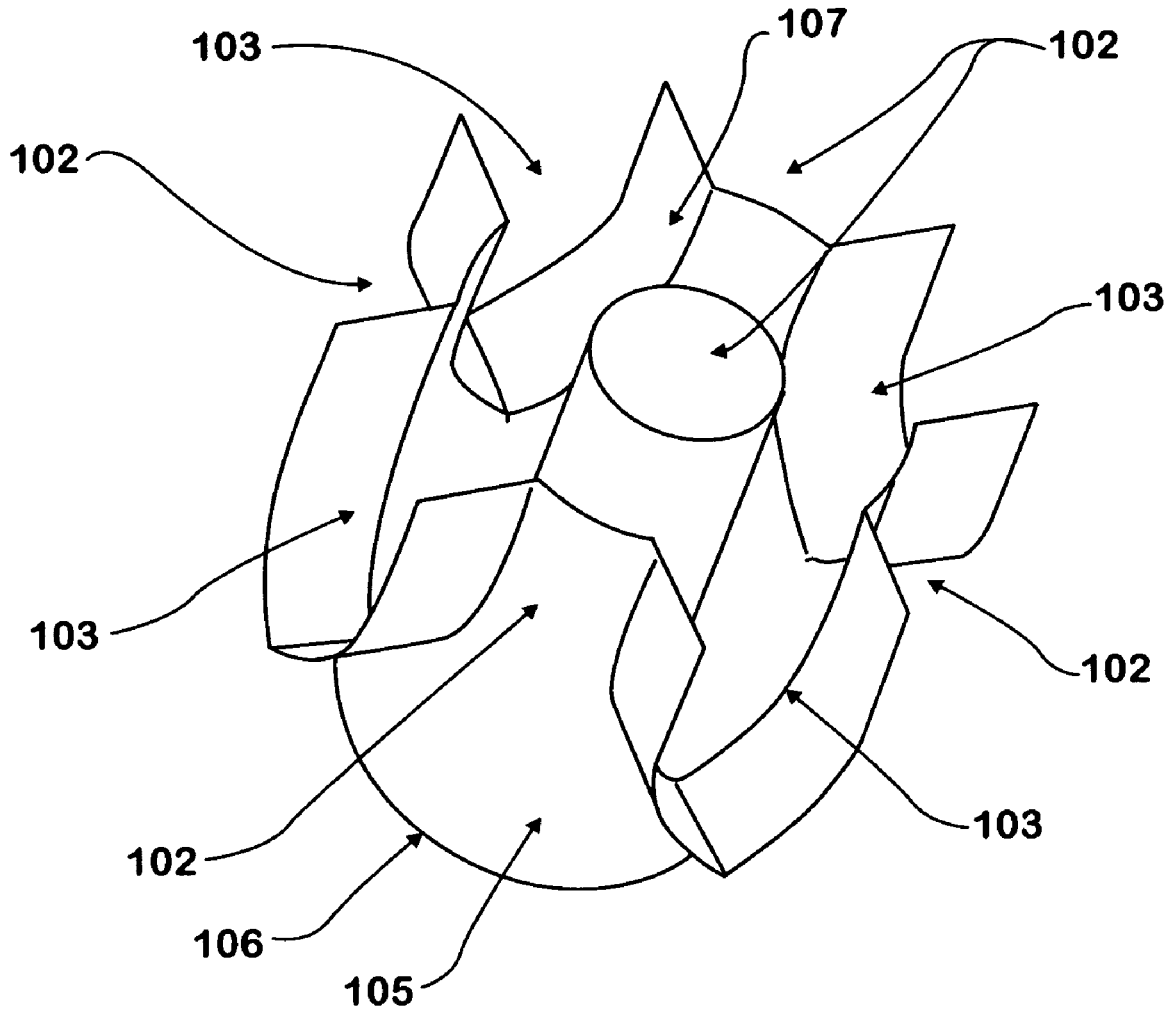
FIG. 6—A sixth embodiment of the invention.

FIG. 6 shows the inner portion 105 of a mixing device 101, in order to clarify the form thereof. The mixing device 101 has an inlet end 106 and an outlet end 107. The exhaust passages 102 and ambient air passages 103 are formed from an essentially contiguous piece of metal. The outer portion (not shown) may be of the same contiguous piece of metal, so that the mixing device 101 is deep drawn and pierced from a single piece of metal. Alternately, the inner portion 105 of the mixing device 101 and the outer portion (not shown) of the mixing device 101 may be formed from separate pieces of metal and subsequently joined. Further, the inner portion 105 and the outer portion (not shown) of the mixing device 101 may be separately cast, or the mixing device 101 may be a single piece casting. Preferably, the mixing device 101 may be a single piece investment casting of stainless steel.

Figure 7:
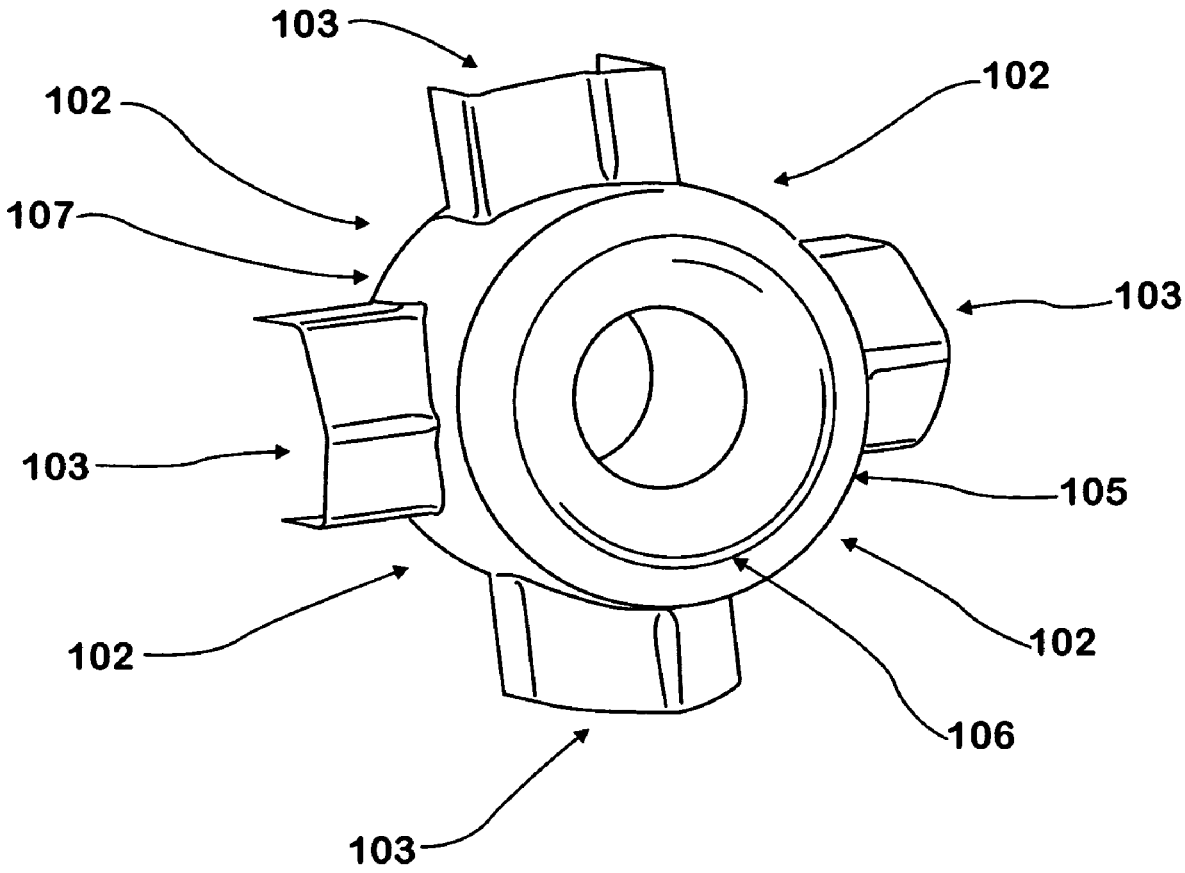
FIG. 7—A seventh embodiment of the invention.

FIG. 7 shows the inner portion 105 of a mixing device 101, similar to the inner portion 105 shown in FIG. 6. The inner portion 105 shown in FIG. 7 again has an inlet end 106, an outlet end 107, exhaust passages 102, and ambient air passages 103. The inner portion 105 may again be formed of a single contiguous piece of stamped metal, and subsequently joined to a separate formed outer portion (not shown), or the inner portion 105 and the outer portion (not shown) may be deep drawn and pierced from a single piece of metal. Similar to the inner portion 105 of the mixing device 101 of FIG. 6, the inner portion 105 of the mixing device 101 of FIG. 7 may be cast, either separately or integrally with the outer portion (not shown).

Figure 8:
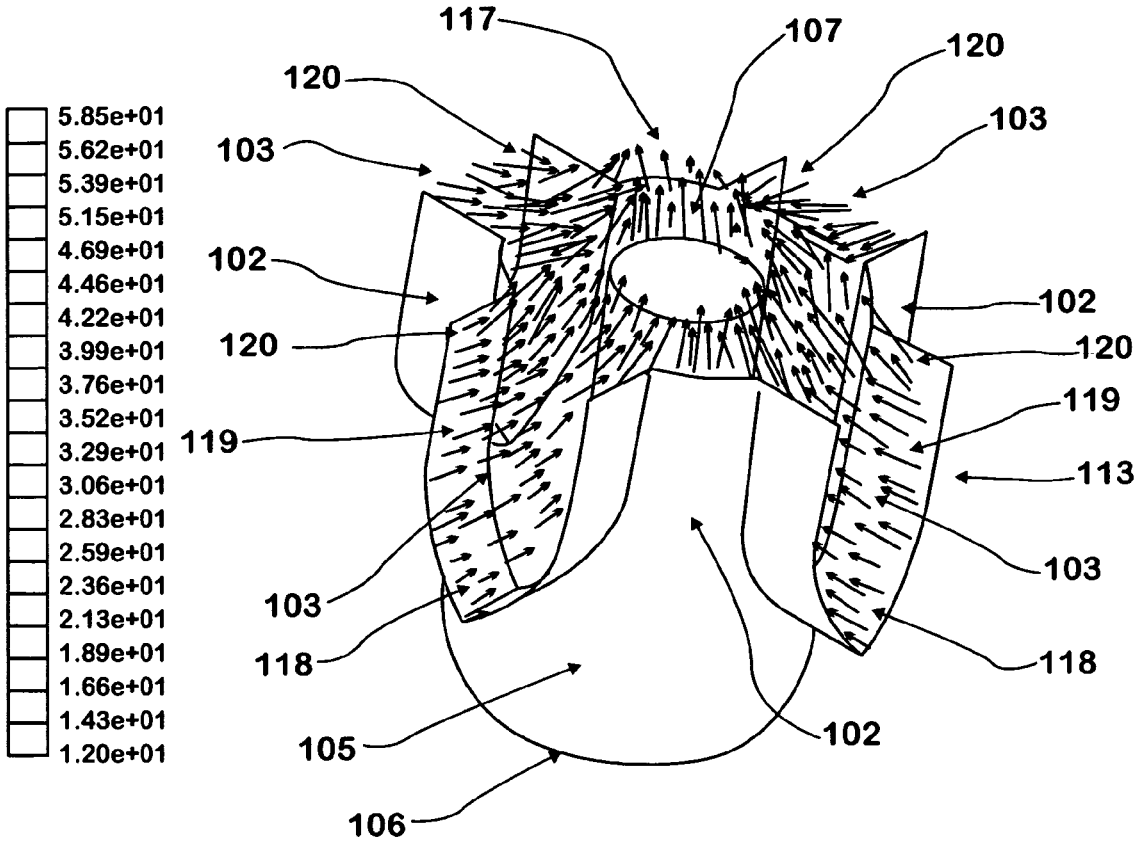
FIG. 8—A eighth embodiment of the invention.

FIG. 8 shows the inner portion 105 of a mixing device 101, similar to the inner portion 105 shown in FIGS. 6 and 7. The inner portion 105 shown in FIG. 8 again has an inlet end 106, an outlet end 107, exhaust passages 102, and ambient air passages 103. Ambient air 113 is drawn into the mixing device 101 by the venturi effect caused by the flow of the high temperature exhaust gases 112 (not shown) as the high temperature exhaust gases 112 exit the exhaust passages 102 and enter the tailpipe 111 (not shown). The flow of ambient air 113 is represented by ambient air flow velocity vectors 117. Generally regions of low velocity ambient air flow are indicated at points 118. Generally regions of medium velocity ambient air flow are indicated at points 119. Generally regions of high velocity ambient air flow are indicated at points 120.

Figure 9:
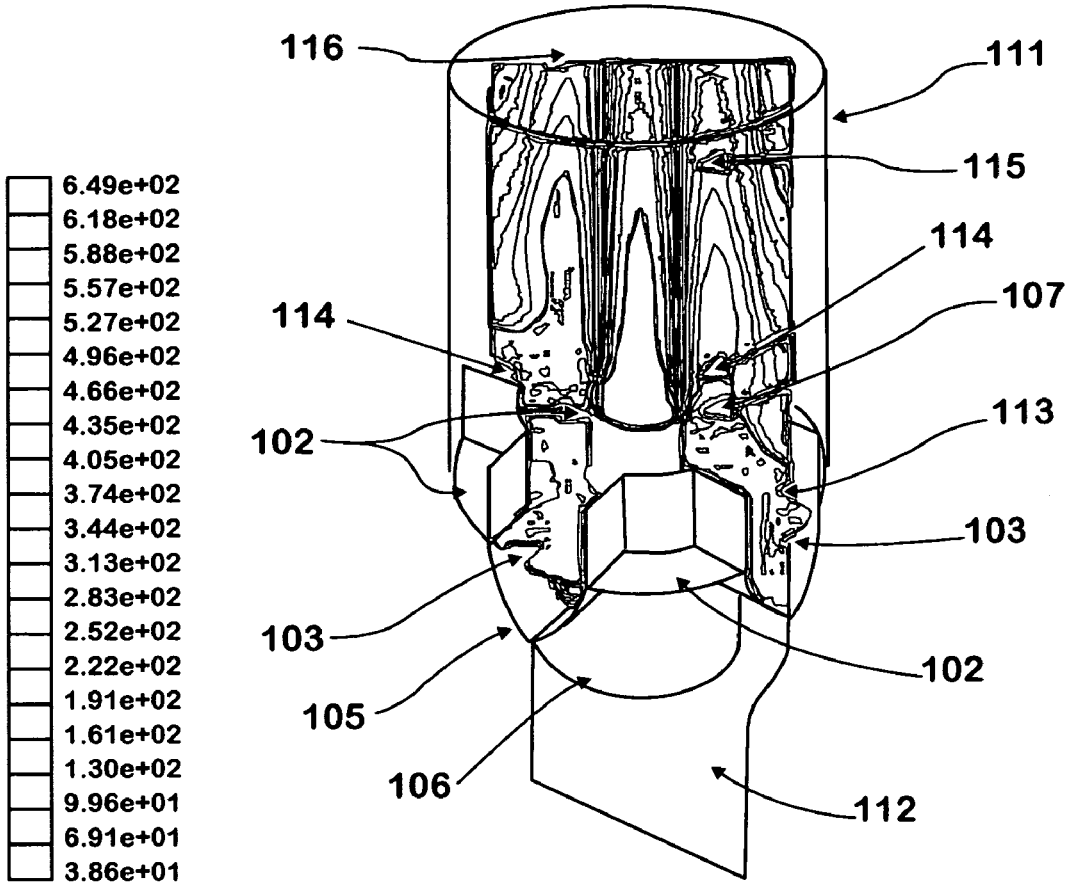
FIG. 9—A ninth embodiment of the invention.

FIG. 9 shows the inner portion 105 of a mixing device 101, similar to the inner portion 105 shown in FIGS. 6-8. The inner portion 105 shown in FIG. 9 again has an inlet end 106, an outlet end 107, exhaust passages 102, and ambient air passages 103. High temperature exhaust gases 112 enter the mixing device 101 at the inlet end 106, pass through the exhaust passages 102, and enter the tailpipe 111. Ambient air 113 enters through the ambient air passages 103. The ambient air 113 is shown entering at about 40° Celsius or about 100° Fahrenheit. The high temperature exhaust gases 112 are shown entering at about 650° Celsius or about 1200° Fahrenheit. There is an area of initial contact 114 between the high temperature exhaust gas 112 and the ambient air 113, followed by a mixing volume 115 within the tailpipe 111. The length of the tailpipe 111 and thus the mixing volume 115 may be varied, in order to accomplish optimum mixing and while maximizing the volume of ambient air that is drawn into the mixing device 101. Finally, lowered temperature mixed air and exhaust gasses 116 exits the tailpipe 111.

Figure 10:
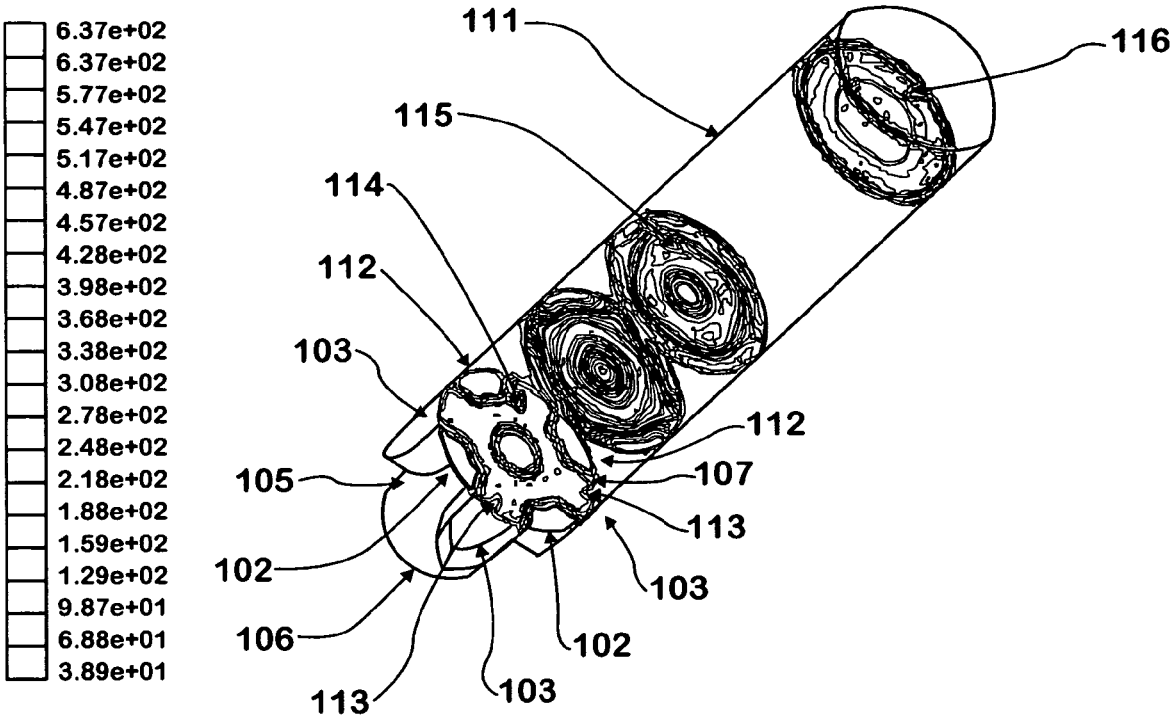
FIG. 10—A tenth embodiment of the invention.

FIG. 10 shows the inner portion 105 of a mixing device 101, similar to the inner portion 105 shown in FIGS. 6-9. The inner portion 105 shown in FIG. 10 again has an inlet end 106, an outlet end 107, exhaust passages 102, and ambient air passages 103. High temperature exhaust gases 112 and ambient air 113 are again shown entering the mixing device 101 and flowing into the tailpipe 111. The ambient air 113 is again shown entering at about 40° Celsius or about 100° Fahrenheit, and the high temperature exhaust gases 112 are shown entering at about 650° Celsius or about 1200° Fahrenheit. There is again an area of initial contact 114 between the high temperature exhaust gas 112 and the ambient air 113, followed by a mixing volume 115 within the tailpipe 111, and lowered temperature mixed air and exhaust gasses 116 exiting the tailpipe 111. The lowered temperature mixed air and exhaust gasses 116 exit the tailpipe 111 at about 340° Celsius or about 640° Fahrenheit.

Figure 11:
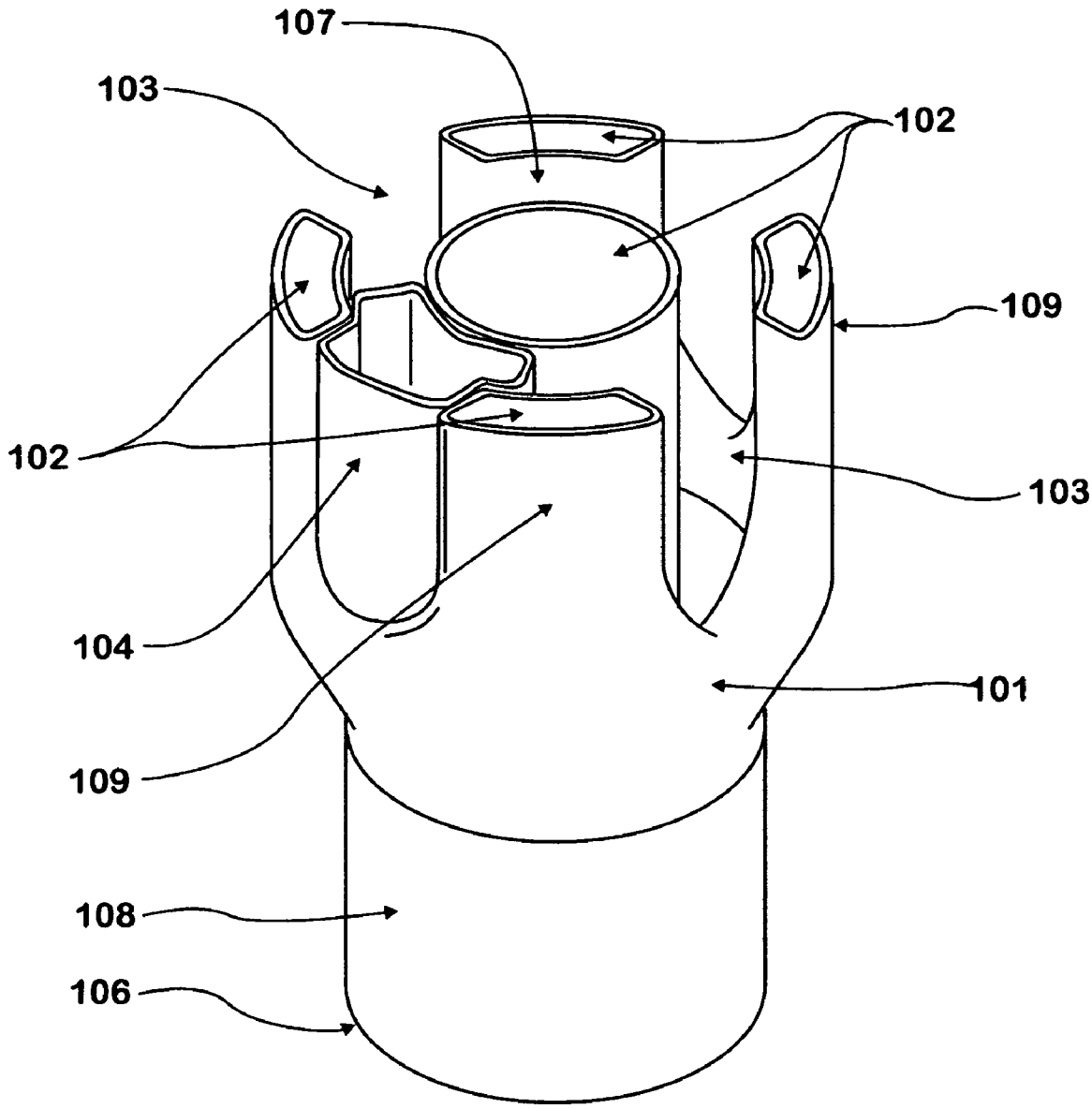
FIG. 11—A eleventh embodiment of the invention.

FIG. 11 shows a mixing device 101 for use in an exhaust system of a vehicle having an internal combustion engine, similar to the mixing device 101 shown in FIG. 1. The mixing device 101 in the embodiment shown in FIG. 11 is again provided with five exhaust passages 102, four ambient air passages 103, an inlet end 106, an engine side exhaust pipe mating surface 108, an outlet end 107, and tailpipe side exhaust pipe mating surface 109. A plug 104 is shown inserted into one of the four ambient air passages 103, which plug may be geometrically locked into place, force fit, or welded into place. The plug 104 is useful for tuning the backpressure of the exhaust system and the amount of ambient air drawn into the exhaust stream.

While specific embodiments have been described in detail in the foregoing detailed description and illustrated in the accompanying drawings, those with ordinary skill in the art will appreciate that various permutations of the invention are possible without departing from the teachings disclosed herein. Accordingly, the particular arrangements disclosed are meant to be illustrative only and not limiting as to the scope of the invention, which is to be given the full breadth of the appended claims and any and all equivalents thereof. Other advantages to a vehicle equipped with an Exhaust Temperature Reduction Device for Aftertreatment Device may also be inherent in the invention, without having been described above.

We claim:

1. A mixing device comprising:

an inlet end able to be mated to an engine side exhaust pipe;

an outlet end able to be mated to a tailpipe;

a periphery;

an interior;

at least two exhaust passages, said at least two exhaust passages each being in fluid communication with said inlet end via a common closed-section inlet at said inlet end of said mixing device, and said at least two exhaust passages each being in fluid communication with said outlet end via individual closed-section outlets at said outlet end of said mixing device, said at least two exhaust passages being operable to bifurcate vehicle exhaust from said engine side exhaust pipe into at least two separate exhaust flow streams;

at least two ambient air passages, said at least two ambient air passages being interposed between and partially surrounding said at least two exhaust passages, said at least two ambient air passages each being in fluid communication with openings in said periphery of said mixing device and said at least two ambient air passages being in fluid communication with said outlet end via a common outlet, said common outlet of said at least two ambient air passages being defined by the area outside of said individual closed-section outlets of said at least two exhaust passages and within said periphery of said mixing device;

said at least two exhaust passages each having a discrete length; and said at least two exhaust passages having at least one central exhaust passage and at least two peripheral exhaust passages.

2. The mixing device of claim 1, wherein:

said mixing device having four peripheral exhaust passages, one central exhaust passage, and four ambient air passages, said four ambient air passages being interposed between and partially surrounding said four peripheral exhaust passages and one central exhaust passage.

3. The mixing device of claim 2, wherein:

said mixing device being manufactured from formed sheet metal.

4. The mixing device of claim 3, wherein:

said mixing device being manufactured using a formed inner portion and a separate formed outer portion, said formed outer portion being joined to said formed inner portion.

5. The mixing device of claim 3, wherein:

said mixing device being manufactured using a single piece of formed sheet metal, said single piece of formed sheet metal being deep drawn and pierced.

6. The mixing device of claim 2, wherein:

said mixing device being manufactured using a net formed process.

7. The mixing device of claim 6, wherein:

said mixing device being manufactured as a casting.

8. The mixing device of claim 6, wherein:

said mixing device being manufactured as investment cast stainless steel.

9. A vehicle for operation on the ground comprising:

a chassis;

an engine attached to said chassis;

an exhaust system connected to said engine, said exhaust system having an engine side exhaust pipe, said engine side exhaust pipe including at least one aftertreatment device, said exhaust system further having a tailpipe;

a mixing device located between said engine side exhaust pipe and said tailpipe, said mixing device being defined by an inlet end, an outlet end, a periphery, and an interior;

said mixing device having at least two exhaust passages, said at least two exhaust passages each being in fluid communication with and receiving vehicle exhaust from said engine side exhaust pipe via a common closed-section inlet at said inlet end of said mixing device, and said at least two exhaust passages each being in fluid communication with and delivering said vehicle exhaust to said tailpipe via individual closed-section outlets at said outlet end of said mixing device, said at least two exhaust passages bifurcating said vehicle exhaust into at least two separate exhaust flow streams;

said mixing device further having at least two ambient air passages, said at least two ambient air passages being interposed between and partially surrounding said at least two exhaust passages, said at least two ambient air passages each being in fluid communication with and receiving ambient air from outside of said exhaust system via individual openings in said periphery of said mixing device, and said at least two ambient air passages being in fluid communication with and delivering said ambient air to said tailpipe via a common outlet at said outlet end of said mixing device, said common outlet of said at least two ambient air passages being defined by the area outside of said individual closed-section outlets of said at least two exhaust passages and within said periphery of said mixing device;

said at least two exhaust passages each having a discrete length; and said at least two exhaust passages having at least one central exhaust passage and at least two peripheral exhaust passages.

10. The vehicle for operation on the ground of claim 9, wherein:

said mixing device having four peripheral exhaust passages, one central exhaust passage, and four ambient air passages, said four ambient air passages being interposed between and partially surrounding said four peripheral exhaust passages and one central exhaust passage.

11. The vehicle for operation on the ground of claim 10, wherein:

said mixing device being manufactured from formed sheet metal.

12. The vehicle for operation on the ground of claim 11, wherein:

said mixing device being manufactured using a formed inner portion and a separate formed outer portion, said formed outer portion being joined to said formed inner portion.

13. The vehicle for operation on the ground of claim 11, wherein:

said mixing device being manufactured using a single piece of formed sheet metal, said single piece of formed sheet metal being deep drawn and pierced.

14. The vehicle for operation on the ground of claim 10, wherein:

said mixing device being manufactured using a net formed process.

15. The vehicle for operation on the ground of claim 14, wherein:

said mixing device being manufactured as a casting.

16. The vehicle for operation on the ground of claim 14, wherein:

said mixing device being manufactured as investment cast stainless steel.

* * * * *